US008480390B2

(12) United States Patent
Hansen

(10) Patent No.: US 8,480,390 B2
(45) Date of Patent: Jul. 9, 2013

(54) DEVICE FOR PRODUCING AND FILLING CONTAINERS

(76) Inventor: Bernd Hansen, Sulzbach-Laufen (DE)

( * ) Notice: Subject to any disclaimer, the term of this patent is extended or adjusted under 35 U.S.C. 154(b) by 141 days.

(21) Appl. No.: 12/736,639

(22) PCT Filed: Jun. 10, 2009

(86) PCT No.: PCT/EP2009/004151

§ 371 (c)(1),
(2), (4) Date: Oct. 26, 2010

(87) PCT Pub. No.: WO2009/152979

PCT Pub. Date: Dec. 23, 2009

(65) Prior Publication Data

US 2011/0076355 A1 Mar. 31, 2011

(30) Foreign Application Priority Data

Jun. 17, 2008 (DE) ..... 10 2008 028 754

(51) Int. Cl.
*B29C 49/04* (2006.01)
*B29C 49/46* (2006.01)

(52) U.S. Cl.
USPC ..... 425/182; 53/561; 53/574; 141/90

(58) Field of Classification Search
USPC ..... 425/182, 524; 264/524; 422/291; 53/561, 53/574; 141/90
See application file for complete search history.

(56) References Cited

U.S. PATENT DOCUMENTS

| | | | | | |
|---|---|---|---|---|---|
| 3,399,508 | A * | 9/1968 | Frielingsdorf et al. | ..... | 53/140 |
| 3,712,784 | A * | 1/1973 | Siard et al. | ..... | 425/526 |
| 4,926,613 | A * | 5/1990 | Hansen | ..... | 53/433 |
| 5,862,840 | A * | 1/1999 | Hansen | ..... | 141/90 |
| 6,179,017 | B1 * | 1/2001 | Walter | ..... | 141/90 |
| 2004/0011004 | A1 | 1/2004 | Kurth | | |
| 2007/0074783 | A1 | 4/2007 | Stocchi | | |

FOREIGN PATENT DOCUMENTS

| | | | |
|---|---|---|---|
| DE | 42 05 655 | A1 | 8/1993 |
| DE | 44 11 629 | A1 | 11/1995 |
| DE | 44 22 713 | A1 | 1/1996 |
| DE | 196 48 087 | A1 | 5/1997 |
| EP | 0 392 622 | A1 | 10/1990 |
| EP | 0 785 134 | A2 | 7/1997 |

* cited by examiner

*Primary Examiner* — Robert B Davis
(74) *Attorney, Agent, or Firm* — Roylance, Abrams, Berdo & Goodman LLP

(57) ABSTRACT

In a device for producing and filling containers, one tube of plastic can be extruded in an open form (17). A filling device (9) having several individual functional channels (21, 39) enables the filling material to be introduced into the container by a filling mandrel (11) associated with a related form (17). A mandrel cover (27) has at least one functional space (31, 35) and establishes a media-guiding connection between its functional space (31, 35) and the associated functional channel (21, 39) of the filling device (9) for cleaning and/or sterilizing and/or drying, in its functional position, and is removed from its functional position during the production and filling of the container.

13 Claims, 4 Drawing Sheets

DEVICE FOR PRODUCING AND FILLING CONTAINERS

FIELD OF THE INVENTION

The invention relates to a device for producing and filling containers in which at least one tube of plasticized plastic material can be extruded into an open mold. By a filling device comprising several function channels separated from one another, at least the filling material can be delivered into the respective containers by a filling mandrel assigned to the pertinent mold.

BACKGROUND OF THE INVENTION

In the pertinent prior art, a system economically enabling automated molding (blow molding or vacuum molding), filling, and sealing of containers is known under the trademark bottelpack®. When the containers are to be filled with highly sensitive products, for example, pharmaceuticals, the international standards for aseptic packaging must be satisfied. To satisfy these standards in the known solutions the mold, when moved into the fill position, is under a sterile filling space (ASR) in which sterile air flows via the open fill opening of the container and forms effective protection against the penetration of germs until movable mold parts are closed after completion of the filling process to make the head closure of the container by a combined vacuum welding process. Such sterile filling spaces and their systems for sterile filling of containers are known in the prior art, for example, in the form of DE 196 48 087 A1 or U.S. Pat. No. 5,862,840.

Careful cleaning and sterilization both of the filling device with its function channels and the parts interacting with it are carried out in rotation and definitely at the start of a production period as a further measure to ensure sterility during production corresponding to Class 100 according to the international classification.

SUMMARY OF THE INVENTION

An object of the invention is to provide a device for producing and filling in which cleaning and sterilization processes can be carried out especially easily and with an improved efficiency relative to the art.

According to the invention, this object is basically achieved by a device comprising a mandrel protective cover having at least one functional space. In its function position, the protective cover produces a media-carrying connection for purposes of cleaning and/or sterilization and/or drying between its functional space and the respectively assignable function channel of the filling device. During container production and filling, the protective cover is moved out of its function position. This protective cover permits delivering those media into the functional space or spaces within the protective cover suitable for cleaning, sterilization, cooling/drying, etc., via a respective function channel of the filling device. In other words, the protective cover forms a component of a cleaning, sterilizing, and/or drier mechanism which can be operated via the corresponding media supply from the filling device to bring the device into an aseptic state for starting the production interval.

In constructions of the device designed for efficient production, at least one filling mandrel can be set into the selected operating positions by longitudinal displacement. In the operating position interacting with the protective cover, the filling mandrel is accommodated with a longitudinal section in at least one functional space of the protective cover in the function position. In this way, the medium intended for the cleaning, sterilization, or drying/cooling process to be carried out can be delivered into the pertinent space within the protective cover directly via the pertinent function channels extending within or along the respective filling mandrel. In this way, not only are cleaning, sterilizing, and drying of the function channels of the system through which the media are flowing accomplished, but the corresponding media also act on the outside surface of the filling mandrel located in the functional space of the protective cover. The processes of cleaning, sterilization, and drying then also act on the outside surface of the respective sections of the filling mandrel held in the protective cover.

In especially advantageous exemplary embodiments, the protective cover has a first and second functional spaces offset relative to one another in the direction of longitudinal displacement of the filling mandrel. The first functional space accommodates that end section of the respective filling mandrel on which is located the outlet of the function channel extending centrally in the filling mandrel and used as the filling channel during filling. That end section of the filling mandrel is directly flushed by the media flowing out of the filling material outlet and through the filling channel. In the creation of the aseptic state of the filling channel itself, at the same time the outside of the end section of the respective filling mandrel is treated.

Preferably, the second functional space of the protective cover is designed to house the longitudinal section of the respective filling mandrel connected to the end section, and has an input opening through which in the corresponding operating position and in the function position of the protective cover the respective filling mandrel extends. Via the input opening the connection between the second functional space and another function channel of the filling device can be established. Such channels can be provided, for example, for the supply of sterile air used as support air in the process of tube formation, or as a supply channel for cooling media. Because a connection is established between the longitudinal section of the filling mandrel accommodated in the second functional space of the protective cover and at least one such media supply channel, the supply of cleaning, sterilizing, and drying media leads not only to the corresponding treatment of media supply channels, but acts in turn on the outer side of the pertinent filling mandrel held in the second functional space of the protective cover.

In designs in which the respective filling mandrel extends through an extruder head, the extruder head preferably has an elongated construction with tube-forming extruder outlet nozzles arranged in a row and assigned a respective row of filling mandrels. The extruder head preferably has a face adjoined flat by the cover wall of the protective cover in its function position. The cover wall has the input opening of the respective second functional space. In especially advantageous exemplary embodiments, the other function channel extends along the outer side of the filling mandrel through the extruder head and ends on its face. By the input opening in the adjoining cover wall of the protective cover, the connection to its second functional space is then formed, specifically by the other function channel continuing along the outer side of the filling mandrel through the input opening into the interior of the protective cover.

Preferably, each functional space of the protective cover has a media output via which the respective media supplied by the connection to the function channels of the filling device, for example, cleaning and/or sterilization media and/or cooling/drying media, can be discharged to the outside.

In advantageous exemplary embodiments, the protective cover forms a protective body whose respective input opening is adjoined by the second functional space separated from the coaxially following first functional space by a seal insert forming a central passage for the entry of the filling needle-like end section of the filling mandrel forming the outlet for the filling material into the first functional space.

The protective cover can be arranged to be able to move by displacing its cover wall along the face of the extruder head into and out of the function position. This arrangement enables a simple construction by only one linear drive for a displacement motion of the protective cover being necessary.

In embodiments characterized by an especially compact structure, the filling device, in addition to the dosing system assigned to the central filling material channel of the respective filling mandrel, also has supply devices by which both the filling material channel and the other function channels can be alternately supplied with the desired treatment and/or working media, that is, for example, with cleaning media, sterilizing media, drying media, or cooling media.

In especially advantageous exemplary embodiments, at least one function channel extending outside the filling mandrel along its outer side can be supplied with a sterile, gaseous medium. In the course of the extrusion process forming the tube, the gaseous medium can be discharged on the face of the extruder head and on the inside of the tube to be used as support air stabilizing the tube. In this way, not only is collapse of the tube prevented prior to the molding process of the container, but sterile air forms a sterile space in the interior of the tube. More accurately, the interior of the tube and the mold, when it is moved into the filling position, are in a sterile filling space (ASR) in which sterile air flows via the open fill opening of the respective container and forms effective protection against the penetration of germs until the movable head jaws of the mold are closed after completion of the filling process to form the desired head closure of the container by a combined vacuum welding process.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
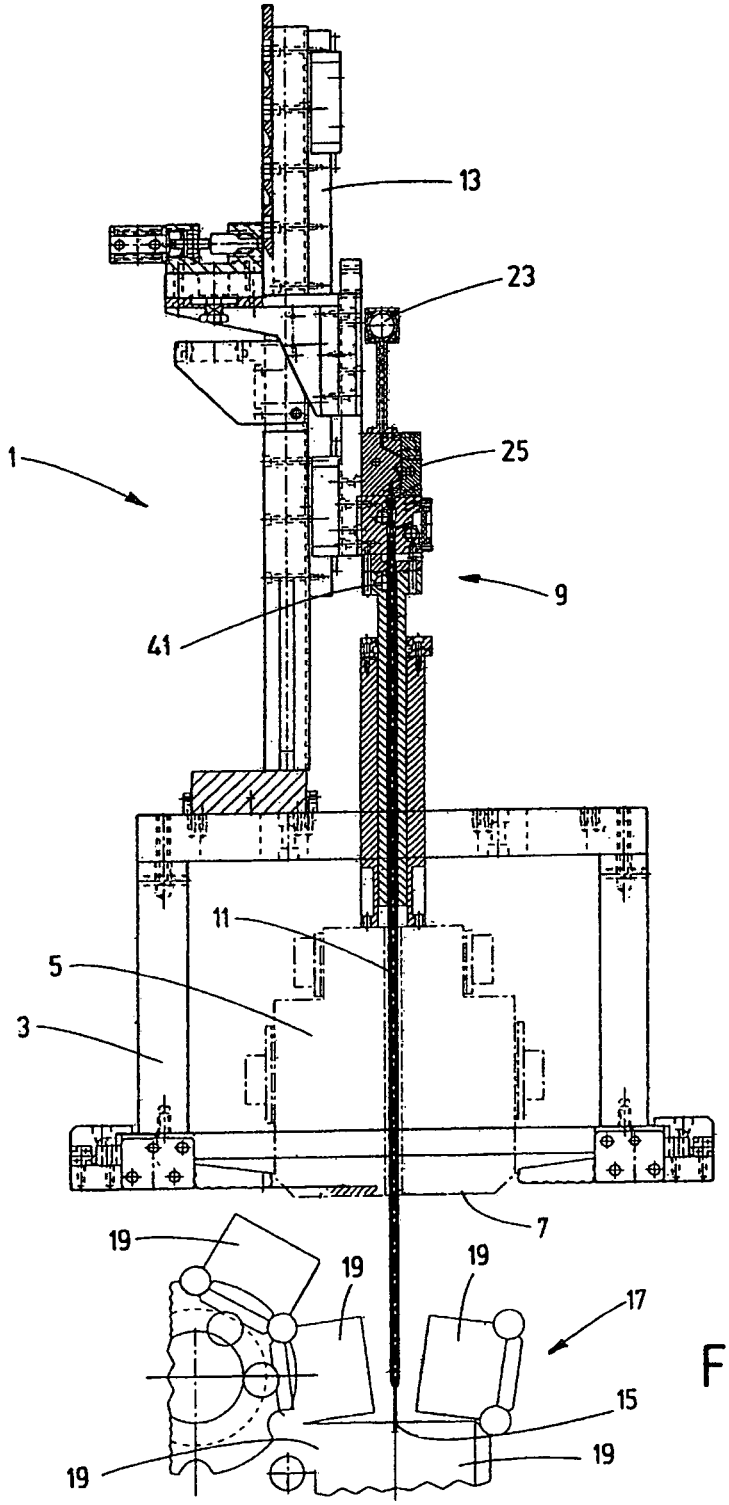
FIG. 1 is a highly schematically simplified side elevational view, partially in section, of one exemplary embodiment of a production device according to the invention, in the operating state of production process being in which the single visible filling mandrel with its filling needle-shaped end extends into the mold with movable mold parts.

FIG. 1 illustrates a device frame 1. On its base frame 3, an extruder head 5 is mounted and has, as is conventional, at least one extrusion nozzle 50 (FIGS. 4 and 5), from which in operation a tube 52 (FIG. 5) emerges. Tube 52 is on a face 7 of the extruder head 5 formed from the plasticized plastic material supplied to the extruder head 5. Since such extruder devices, for example, in the form of devices operated according to the bottelpack® process, are inherently known, such that further explanation of the details of the extruder head 5 is unnecessary. A filling device 9 with at least one filling mandrel 11 extends in the extruder head 5 in the longitudinal direction. While in the figures only one filling device 9 with a filling mandrel 11 is shown at a time, the extruder head 5 is preferably elongated in the direction perpendicular to the plane of the drawing, such that a plurality of filling devices 9 can be located in a row perpendicular to the plane of the drawing with filling mandrels 11.

In a conventional manner for such devices, the respective filling mandrel 11 can be moved in the longitudinal direction into various chosen operating positions, for example, such that with its filling device 9 it is movably supported on the frame carrier 13. The filling mandrels 11 can be set clock-controlled into the operating positions necessary for the production and filling process and for cleaning, sterilization, and drying.

Figure 4:
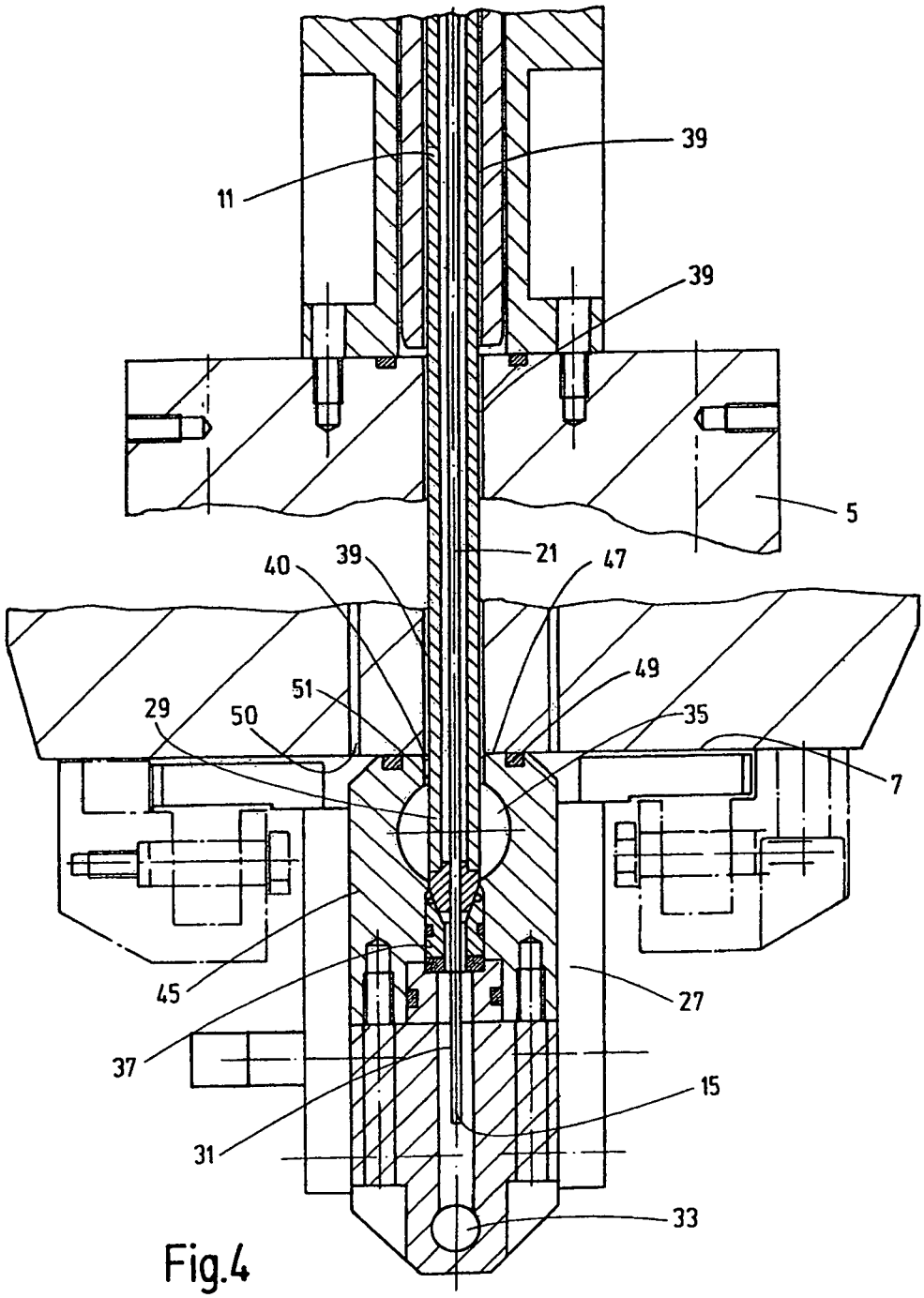
FIG. 4 is an enlarged side elevational view partially in section and partially broken away, of production device in the operating and function positions shown in FIG. 2.
Figure 5:
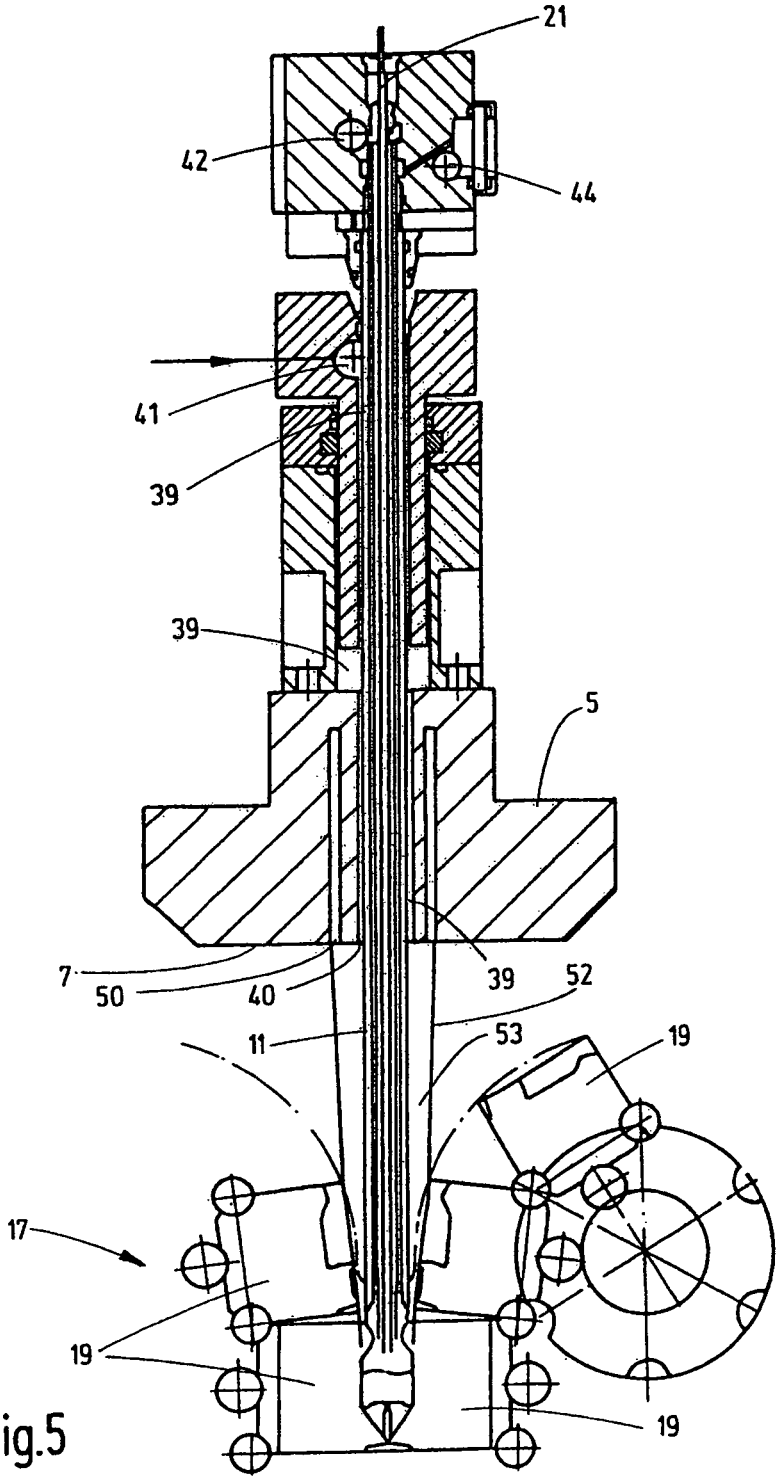
FIG. 5 is a schematically simplified side elevational view in section of the production device of FIG. 1 in the filling position of the single visible filling mandrel and a sterile space extending within the tube along its outer side between the extruder head and mold.

FIGS. 1 and 5 show the filling mandrel 11 in the advanced operating position for a filling process. The end section 15, tapered in the shape of a filling needle, is advanced into a mold 17 not yet closed on the head side. In the manner of a revolver arrangement, individual mold parts 19 are moved in pairs toward one another on an imaginary arc path to form a closed production mold, and are moved apart again for opening of the mold. For dosed delivery of the filling material from the end section 15, each filling mandrel 11 has a centrally located function channel in the form of a filling channel 21 in FIGS. 4 and 5. From a central filling material line 23, controllable dosing units 25 of each filling device 9 can be delivered with the product to be added. The dosing units 25 deliver the dosed amounts required for each filling process clock-controlled to the pertinent filling channel 21.

Figure 2:
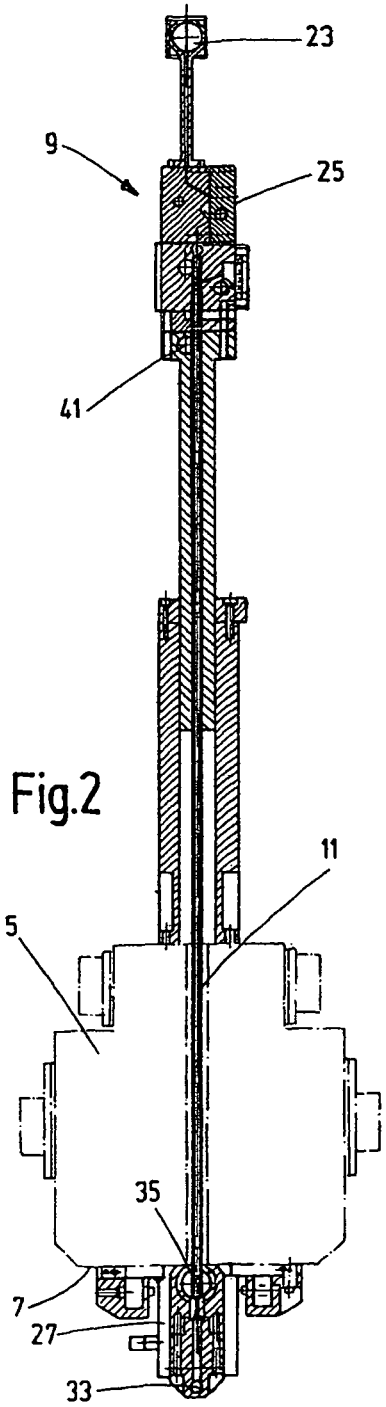
FIG. 2 is a side elevational view of only the extruder head and the filling mandrel with the pertinent filling device, slightly enlarged of FIG. 1 and partially in the filling mandrel being shown in the operating position in which it is held with a longitudinal section in the protective cover in its function position on the face of the extruder head.
Figure 3:
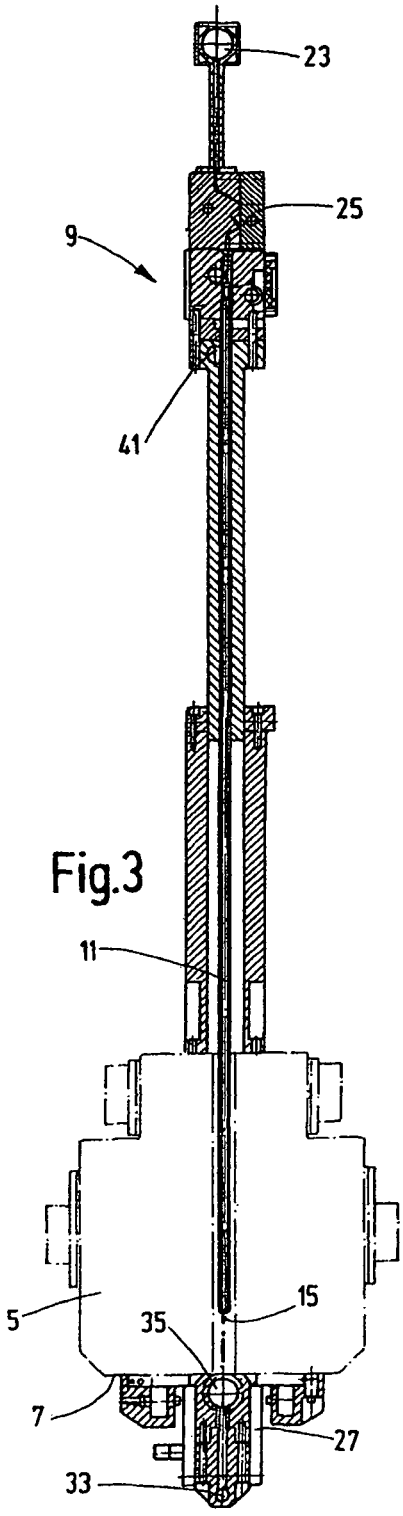
FIG. 3 is a side elevational view partially in section of only the extruder head and filling mandrel of FIG. 1 where the filling mandrel is withdrawn into the operating position into the extruder head and the protective cover can be moved out of its function position.

In contrast to FIGS. 1 and 5, FIGS. 2 to 4 show the operating positions which the pertinent filling mandrel 11 assumes, while preparatory measures are carried out before production is started. In this respect, FIGS. 2 and 4 show one operating position in which the filling mandrel 11 has been withdrawn from the region of the mold 17 and is held with a longitudinal region within a protective cover 27. FIG. 4 best illustrates the fill needle-shaped end section 15 with the filling material outlet and a longitudinal section 29 connected to it (FIG. 4). The end section 15 is in a first functional space 31 within the protective cover 27, an output channel 33 forming a media outlet from the space 31. The longitudinal section 29 connected to the end section 15 is held in the protective cover 27 in a second functional space 35 from which likewise an output channel (not shown) enables discharge of the media to the outside. The spaces 31 and 35 are separated from one another by a seal insert 37 through which the fill needle-like end section 15 extends into the first space 31 when the filling mandrel 11 assumes the operating position shown in FIGS. 2 and 4. Besides the function channels extending conventionally in the filling mandrel 11 in such devices, like the central filling channel 21, at least one other function channel extends and is used as a feed channel 39 for the media, as shown in detail only in FIGS. 4 and 5. This other function channel 39 extends along the outer side of the pertinent filling mandrels 11, as is apparent from FIGS. 4 and 5, proceeding from an inflow supply connection 41 (FIG. 5), continuing as far as to an outlet mouth 40 on the face 7 of the extruder head 5. Connections intended for additional function channels may be present, for example, for the mandrel cooling input 42 and mandrel cooling outlet 44 (FIG. 5).

In the operating state shown in FIGS. 2 and 4, the cover body 45 of the protective cover 27 has its cover wall 47 adjoining the face 7 of the extruder head 5 flat. The edge of the input opening 51 in the cover wall 47 of the cover body 45 is aligned to the mouth 40 of the function channel 39 so that the function channel 39 continues into the interior of the second functional space 35 via the input opening 51. At the same time, the first functional space 31 of the protective cover 27 is connected to the filling channel 21 by the filling material opening on the end section 15.

In the state shown in FIGS. 2 and 4, the cover body 45 of the protective cover 27 with its cover wall 47 adjoins the face 7 of the extruder head 5 flat within the edge of the pertinent extrusion nozzle opening 50. The extrusion nozzle 50 is sealed relative to mouth 40 by a seal arrangement 49 held in the cover wall 47. Within the seal arrangement 49, the cover wall 47 of the body 45 has an input opening 51 through which the longitudinal section 29 of the filling mandrel 11 extends into the protective cover 27. The size of the entry opening 51 is dimensioned such that the mouth 40 of the media supply channel 39 on the edge of the entry opening 51 is connected to the second functional space 35 in the protective cover 27. At the same time, the first functional space 31 of the protective cover 27 is connected to the filling channel 21 on the end section 15 by way of the filling material opening.

In this operating state, all the measures associated with cleaning and sterilizing can be carried out via the connection between the channels 21, 39 of the filling mandrel 11 with the spaces 31 and 35 of the protective cover 27. In this respect, it is possible to proceed such that by way of the supply connection 23 and the dosing system 25 switched into the through-flow state, cleaning liquid cleaning the filling channel 21 is delivered into the functional space 31 from which the liquid emerges via the channel 33. By the connection between the media supply channel 39 and the second functional space 35, from the supply connection 41 of the filling device 9 further supply of media is possible, resulting in the longitudinal section 29 of the filling mandrel 11 being cleaned or sterilized on the peripheral side. In the same operating position of the filling mandrel 11 and when the protective cover 27 is in the function position, following the cleaning of the filling channel 21, the sterilization process can be initiated by superheated steam of at least 121° C. flowing in by the filling device 9 via the filling channel 21, sterilizing the inside of the filling channel 21, as well as the outer side of the end section 15 within the space 31 of the protective cover 27. In the corresponding manner, sterilizing superheated steam can be delivered into the space 35 of the protective cover 27 via the media supply channel 39 so that the outside of the section 29 is sterilized as well.

In the conventional manner conventional in cleaning and sterilizing processes, the corresponding drying/cooling processes can then be carried out via the same media connections. The condensate of the preceding sterilizing steam is blown out by supplying sterile air.

Subsequent to the drying, the pertinent filling mandrel 11 is withdrawn into the operating position shown in FIG. 3. The protective cover 27 is then moved out of the function position shown in FIGS. 2 to 4. The protective cover 27, for example, is pushed in the direction perpendicular to the plane of the drawing on the face 7 of the extruder head 5.

After moving the protective cover 27 out of the function position, the device is ready for the start of a production interval. Because the mouth 40 of the function channel 39 extending along the outside of the filling mandrel 11 during the production phase shown in FIGS. 1 and 5 is located within the tube 52 (FIG. 5) emerging from the extrusion nozzle opening 50, the medium supplied via the function channel 39 flows into the interior of the tube 52. The tube 52, in its path from the extruder head 5 into the mold 17, then forms a closed space. When sterile air flows in tube 52 via the function channel 39, a sterile filling space 53 is formed within which the entire production process is carried out, i.e., up to formation of the head closure on the filled container. The head closure formation is done by closing the pertinent head jaws of the mold 17. Since the corresponding mechanisms of the mold are known, in the drawings the mold 17 is schematically simplified without a separate representation of the primary mold parts and head mold parts. The execution according to the invention therefore yields not only stabilization of the tube by the supplied support air via the outlet mouth 40, but also, by sterile air being blow in, the formation of a sterile zone so that the device satisfies international standards with respect to asepsis (Class 100) to a special degree.

While one embodiment has been chosen to illustrate the invention, it will be understood by those skilled in the art that various changes and modifications can be made therein without departing from the scope of the invention as defined in the appended claims.

What is claimed is:

1. A device for producing and filling containers, comprising:

an extruder;

a mold alignable with said extruder and receiving a tube of plasticized plastic material from said extruder;

a filling device including several function channels separate from one another and a filling mandrel having a central functional channel delivering filling material out an outlet on an end section of said filling channel to a container formed in said mold, said filling mandrel being movable into selected operating positions by longitudinal displacement thereof; and a protective cover being movable into and out of a functional position, having a first functional space and a second functional space offset relative to one another in a direction of the longitudinal displacement of said filling mandrel and having a media carrying connection in the functional position thereof for at least one of cleaning, sterilizing and drying of said filling device and the respective function channels thereof, said filling mandrel interacting with said protective cover with a longitudinal section thereof in at least one of said functional spaces in the functional position of said protective cover, said first functional space receiving said end section of said filling mandrel.

2. A device according to claim 1 wherein said second functional space houses said longitudinal section of said filling mandrel, said longitudinal section being connected to said end section of said filling mandrel, said second functional space having an input opening connecting another function channel of the filling device to said second functional space in an operating position of the filling device and in functional position of the protective cover.

3. A device according to claim 2 wherein said filling mandrel extends through an extruder head of said extruder, said extruder head having a face adjoined flat by a cover wall of said protective cover in the functional position thereof, said input opening being in said cover wall, said other functional channel extending along an outer side of said filling mandrel, through said extruder head and ending on said face.

4. A device according to claim 1 wherein each of said first and second functional spaces comprises a media outlet discharging respective media supplied by connections to said function channels to an outside environment.

5. A device according to claim 4 wherein said protective cover comprises a protective body having an input opening adjoined by said second functional space, said second functional space being separated from said first functional space by an insert seal, said first functional space following coaxially from said second functional space, said seal insert forming a central passage for entry of said end section of said filling mandrel, said end section being needle-shaped.

6. A device according to claim 5 wherein said protective cover is movable by displacing a cover wall thereof along a face of said extruder into and out of the functional position.

7. A device according to claim 1 wherein said filling device comprises a dosing system in fluid communication with said central function channel and comprises supply devices alternatively supplying at least one of filling material, cleaning media, sterilizing media, drying media and cooling media to the respective function channels.

8. A device according to claim 7 wherein at least one of said function channels is located outside said filling mandrel, forms a flow path routed along an outer side of said filling mandrel and is supplied with a sterile, gaseous medium dischargeable on a face of an extruder head of said extruder and into an inside of a tube formed during an extrusion process with the sterile, gaseous medium being support air stabilizing the tube and forming a sterile zone in the tube.

9. A device for producing and filling containers, comprising:

an extruder;

a mold alignable with said extruder and receiving a tube of plasticized plastic material from said extruder;

a filling device including several function channels separate from one another and a filling mandrel delivering filling material to a container formed in said mold; and a protective cover being movable into and out of a functional position, having a first and second functional spaces and having a media carrying connection in the functional position thereof for at least one of cleaning, sterilizing and drying of said filling device and the respective function channels thereof, each of said first and second functional spaces having a media outlet discharging respective media supplied by connections to said function channels to an outside environment, said protective cover including a protective body having an input opening adjoined by said second functional space, said second functional space being separated from said first functional space by an insert seal, said first functional space following coaxially from said second functional space, said seal insert forming a central passage for entry of an end section of said filling mandrel, said end section being needle-shaped.

10. A device according to claim 9 wherein said protective cover is movable by displacing a cover wall thereof along a face of said extruder into and out of the functional position.

11. A device according to claim 9 wherein said filling device comprises a dosing system in fluid communication with a central one of said function channels and comprises supply devices alternatively supplying at least one of filling material, cleaning media, sterilizing media, drying media and cooling media to the respective function channels.

12. A device according to claim 11 wherein at least one of said function channels is located outside said filling mandrel, forms a flow path routed along an outer side of said filling mandrel and is supplied with a sterile, gaseous medium dischargeable on a face of an extruder head of said extruder and into an inside of a tube formed during an extrusion process with the sterile, gaseous medium being support air stabilizing the tube and forming a sterile zone in the tube.

13. A device for producing and filling containers, comprising:

an extruder;

a mold alignable with said extruder and receiving a tube of plasticized plastic material from said extruder;

a filling device including several function channels separate from one another and a filling mandrel delivering filling material to a container formed in said mold; and a protective cover movable into and out of a functional position, having a first functional space and having a media carrying connection in the functional position thereof for at least one of cleaning, sterilizing and drying of said filling device and the respective function channels thereof, said filling device including a dosing system in fluid communication with a central one of said function channels and including supply devices alternatively supplying at least one of filling material, cleaning media, sterilizing media, drying media and cooling media to the respective function channels, at least one of said function channels being located outside said filling mandrel, forming a flow path routed along an outer side of said filling mandrel and being supplied with a sterile, gaseous medium dischargeable on a face of an extruder head of said extruder and into an inside of a tube formed during an extrusion process with the sterile, gaseous medium being support air stabilizing the tube and forming a sterile zone in the tube.

* * * * *